United States Patent [19]

Lockard

[11] Patent Number: 4,826,443

[45] Date of Patent: May 2, 1989

[54] CONTACT SUBASSEMBLY FOR AN ELECTRICAL CONNECTOR AND METHOD OF MAKING SAME

[75] Inventor: Joseph L. Lockard, Harrisburg, Pa.

[73] Assignee: AMP Incorporated, Harrisburg, Pa.

[21] Appl. No.: 62,296

[22] Filed: Jun. 12, 1987

Related U.S. Application Data

[60] Division of Ser. No. 852,672, Apr. 16, 1986, Pat. No. 4,682,840, which is a division of Ser. No. 769,552, Aug. 26, 1985, Pat. No. 4,602,831, which is a continuation of Ser. No. 536,017, Sep. 26, 1983, abandoned, which is a continuation-in-part of Ser. No. 442,472, Nov. 17, 1982, abandoned, which is a continuation of Ser. No. 670,662, Nov. 13, 1984, abandoned.

[51] Int. Cl.[4] ..... H01R 4/66

[52] U.S. Cl. ..... 439/101; 29/856; 439/606; 439/610

[58] Field of Search ..... 439/101, 460, 497, 606, 439/607, 610, 733, 736; 29/856

[56] References Cited

U.S. PATENT DOCUMENTS

| | | | |
|---|---|---|---|
| 3,086,251 | 4/1963 | Bernat | 339/218 M |
| 3,315,218 | 4/1967 | Aker | 339/218 R |
| 3,411,130 | 11/1968 | Bushey | 339/176 |
| 3,569,900 | 3/1971 | Uberbacker | 339/14 |
| 3,634,806 | 1/1972 | Fergusson | 339/14 R |
| 3,689,865 | 9/1972 | Pierini et al. | 439/607 X |
| 3,713,073 | 1/1973 | Narozny | 339/17 F |
| 3,731,251 | 5/1973 | Sinclair | 339/17 F |
| 4,043,630 | 8/1977 | Suverison et al. | 339/218 M |
| 4,163,598 | 8/1979 | Bianchi et al. | 339/107 |
| 4,173,388 | 11/1979 | Brandeau | 339/276 T |
| 4,225,208 | 9/1980 | Brandeau et al. | 339/95 R |
| 4,269,466 | 5/1981 | Huber | 339/107 |
| 4,441,778 | 4/1984 | Sampson | 339/99 R |

FOREIGN PATENT DOCUMENTS 2018054 10/1979 United Kingdom .

*Primary Examiner*—Eugene F. Desmond

*Attorney, Agent, or Firm*—Adrian J. LaRue; Anton P. Ness

[57] ABSTRACT

An electrical plug connector comprises a dielectric contact-carrying member having signal contact members secured to one side of the contact-carrying member at spaced intervals therealong. A ground contact member is secured to the other side of the contact carrying member with contact sections of the signal contact members and the ground contact member extending from a front end of the contact-carrying member. Conductor-connecting sections of the signal and ground contact members extending along the contact-carrying member. Signal conductors and ground conductors of electrical cables are electrically connected respectively to the conductor-connecting sections of the signal contact members and the ground contact member. A dielectric housing member is secured onto the contact-carrying member and part of the electrical cables so that the contact members from their contact sections to their conductor-connecting sections are covered. The signal and ground conductors are electrically connected to the signal contacts and the ground contact member respectively by first being force-fitted into respective slots thereof and then terminated by being laser welded thereto.

4 Claims, 9 Drawing Sheets

24
74
34
32
22
34
72
32
34
24
74

30
16
28
20
26
32
34
74
76
82
24
80
22
73
78
72
64

32
34
30
74
16
28
76
82
24
26
80
22
73
78
72
20
64

CONTACT SUBASSEMBLY FOR AN ELECTRICAL CONNECTOR AND METHOD OF MAKING SAME

REFERENCE TO RELATED APPLICATIONS

This is a divisional application of prior application Ser. No. 06/852,672 filed on Apr. 16, 1986, now Pat. No. 4,682,840, which was a divisional application of Application Ser. No. 06/769,552 filed Aug. 26, 1985 (now U.S. Pat. No. 4,602,831), which was a continuation application of Application Ser. No. 06/536,017 filed Sept. 26, 1983 (now abandoned), which was a continuation-in-part application of Application Ser. No. 06/442,472 filed Nov. 17, 1982 (now abandoned), on which a continuation application was filed as Application Ser. No. 06/670,662 filed Nov. 13, 1984 (now abandoned).

FIELD OF THE INVENTION

This invention relates to electrical connectors and more particularly to an electrical plug connector in which electrical conductors of electrical cables are terminated to contact members and the terminations are sealingly secured in a housing that supports the cables and is latchably mounted in a polarized position in a connector-receiving member.

BACKGROUND OF THE INVENTION

Electrical connectors for transmission cables terminate the conductors of such cables. The connectors are generally detachably connected to other electrical connectors for transmitting electrical signals from a transmission source to a receiving member or vice versa.

The connectors must be constructed to minimize losses or irregularities in the signals being transmitted from the transmission source to the receiving member. The construction of the connectors must also be concerned with electrical performance characteristics so that they are not affected by wear and handling that results when equipment is moved and detachable connection and reconnection with other connectors take place.

SUMMARY OF THE INVENTION

According to the present invention, an electrical connector such as on electrical plug connector comprises a dielectric contact-carrying member having signal contact members secured to one side of the contact-carrying member at spaced intervals therealong. A ground contact members is secured to the other side of the contact-carrying member with contact sections of the signal contact members and the ground contact member extending outwardly from a front end of the contact-carrying member. Conductor-connecting sections of the signal and ground contact members extend along the contact-carrying member so that signal conductors and ground conductors of electrical cables are electrically connected respectively to the conductor-connecting sections of the signal contact members and the ground contact member. A dielectric housing member is secured onto the contact-carrying member and part of the electrical cables so that the contact members from their contact sections and along their conductor-connecting sections are covered.

DETAILED DESCRIPTION OF THE INVENTION

Figure 1:
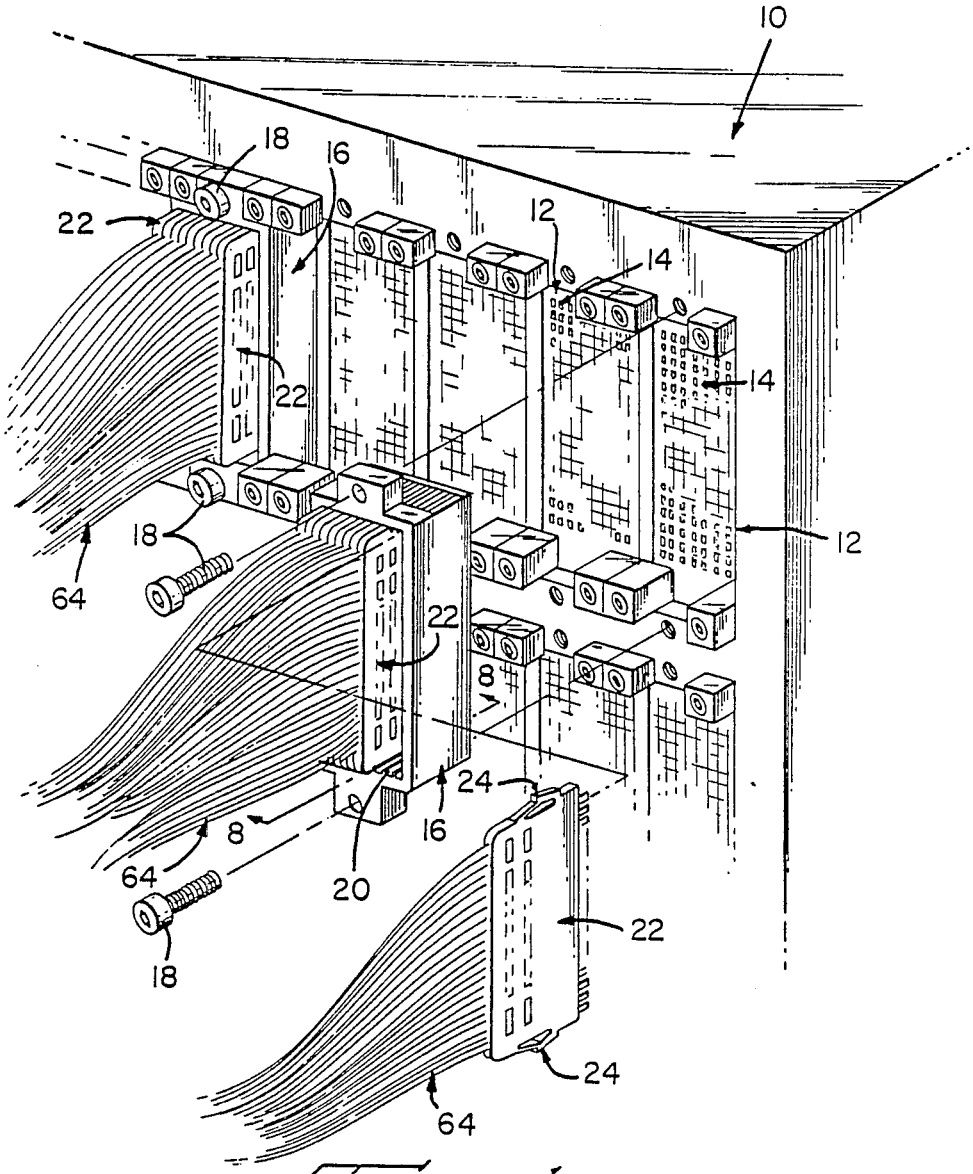
FIG. 1 is a perspective and exploded view of an electrical connection system in which the invention is typically used.
Figure 2:
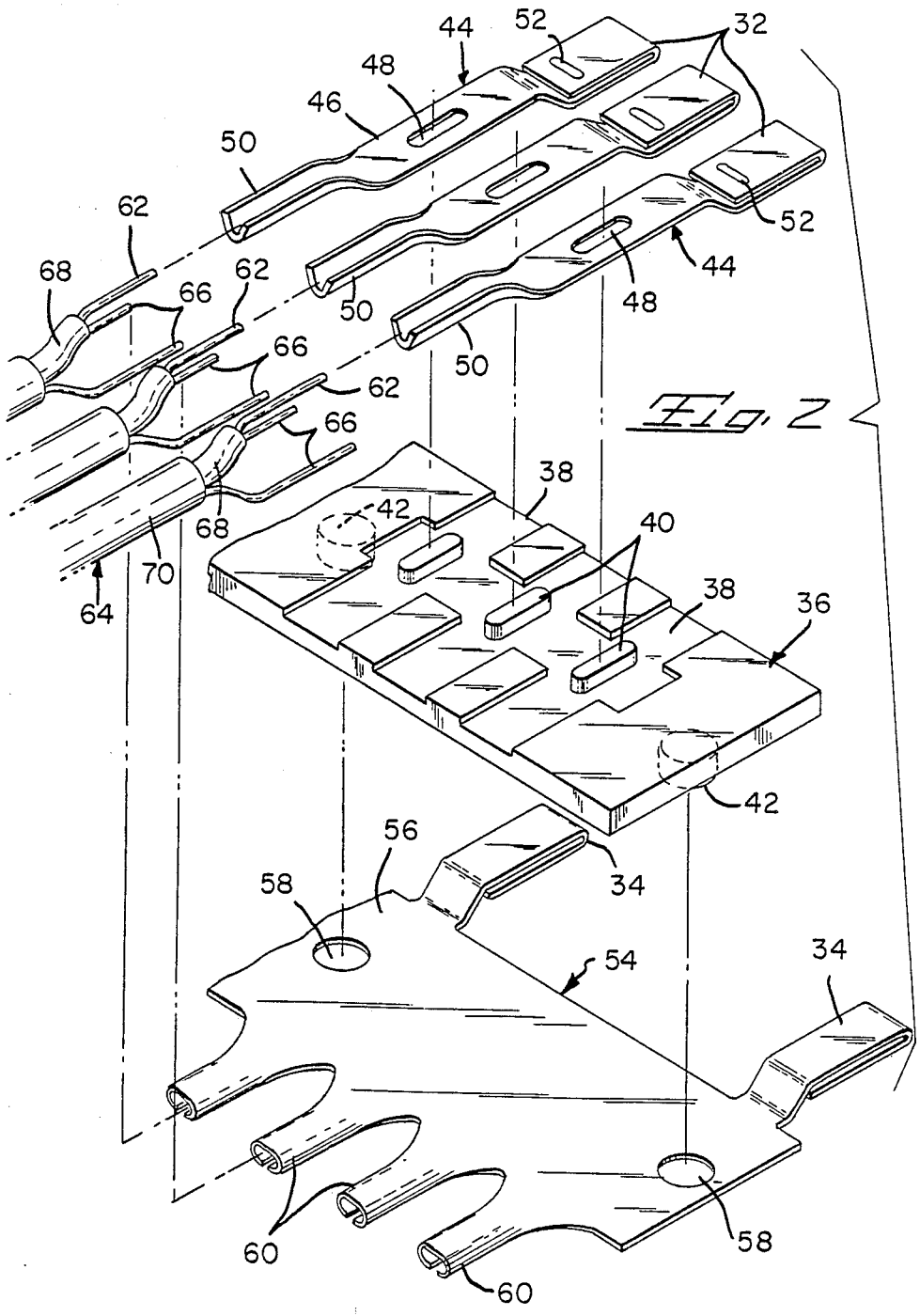
FIG. 2 is a perspective and exploded view showing the parts of an electrical contact assembly of the connector.
Figures 7, 8, 9:
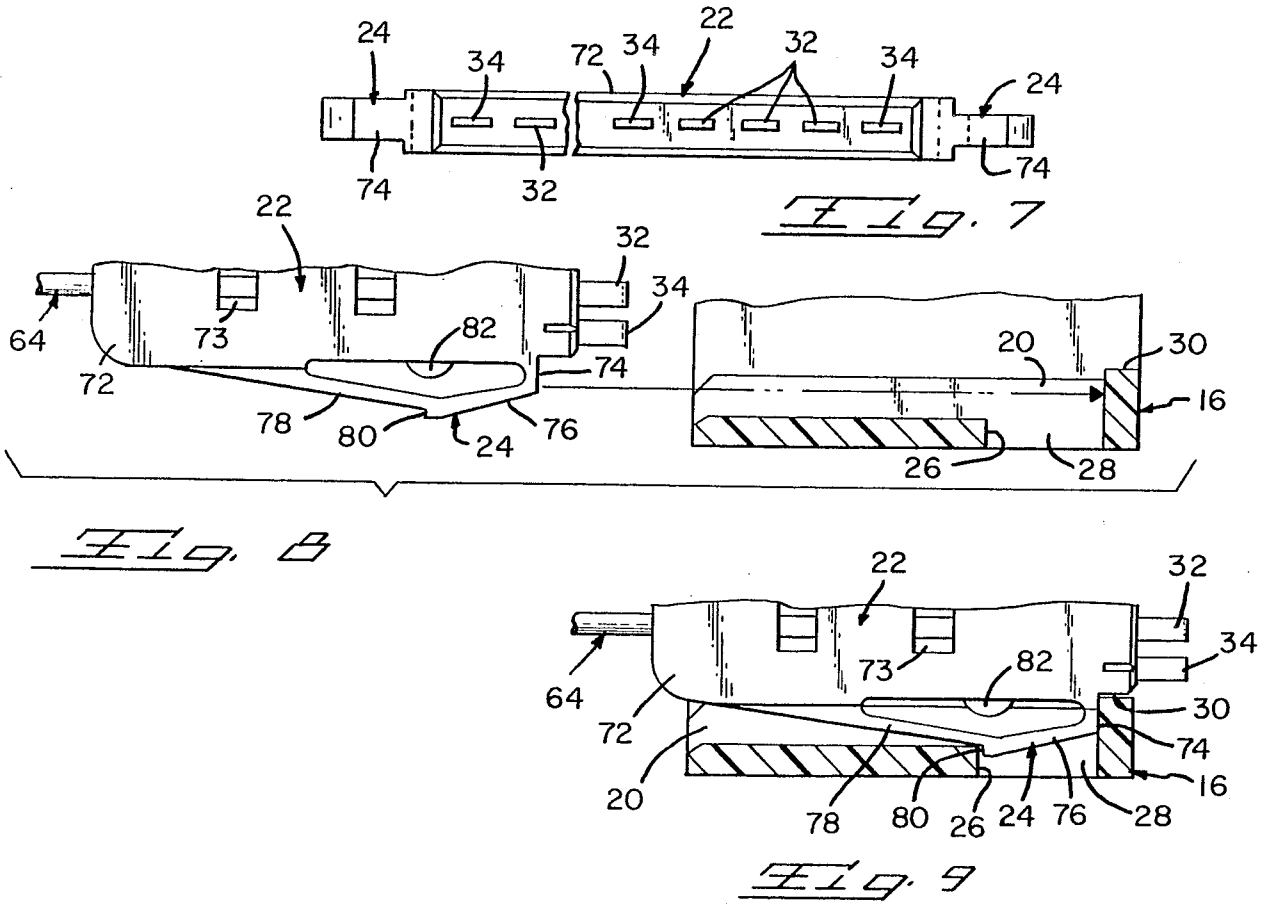
FIG. 7 is a front elevational view of the plug connector.
FIGS. 8 and 9 show parts of the connector and connector-receiving member illustrating the latching arrangement.

As shown in FIG. 1, a multilayer circuit board 10 has areas 12 in which matrices of electrical receptacle contacts 14 are disposed. Connector-receiving members 16 are secured in position on board 10 via bolts 18. Spaced projections 20 are located along the inside surfaces of the tops and bottoms of members 16, forming channels in which electrical plug connectors 22 are latchably secured by flexible latch members 24 engaging surfaces 26 in openings 28 of members 16 as shown in FIGS. 8 and 9. This enables a front section of connectors 22 to be positioned through front openings 30 in members 16 so that tab contact sections 32 and 34 of connectors 22 can be electrically connected with respective receptacle contacts 14 in areas 12.

Figures 5, 6:
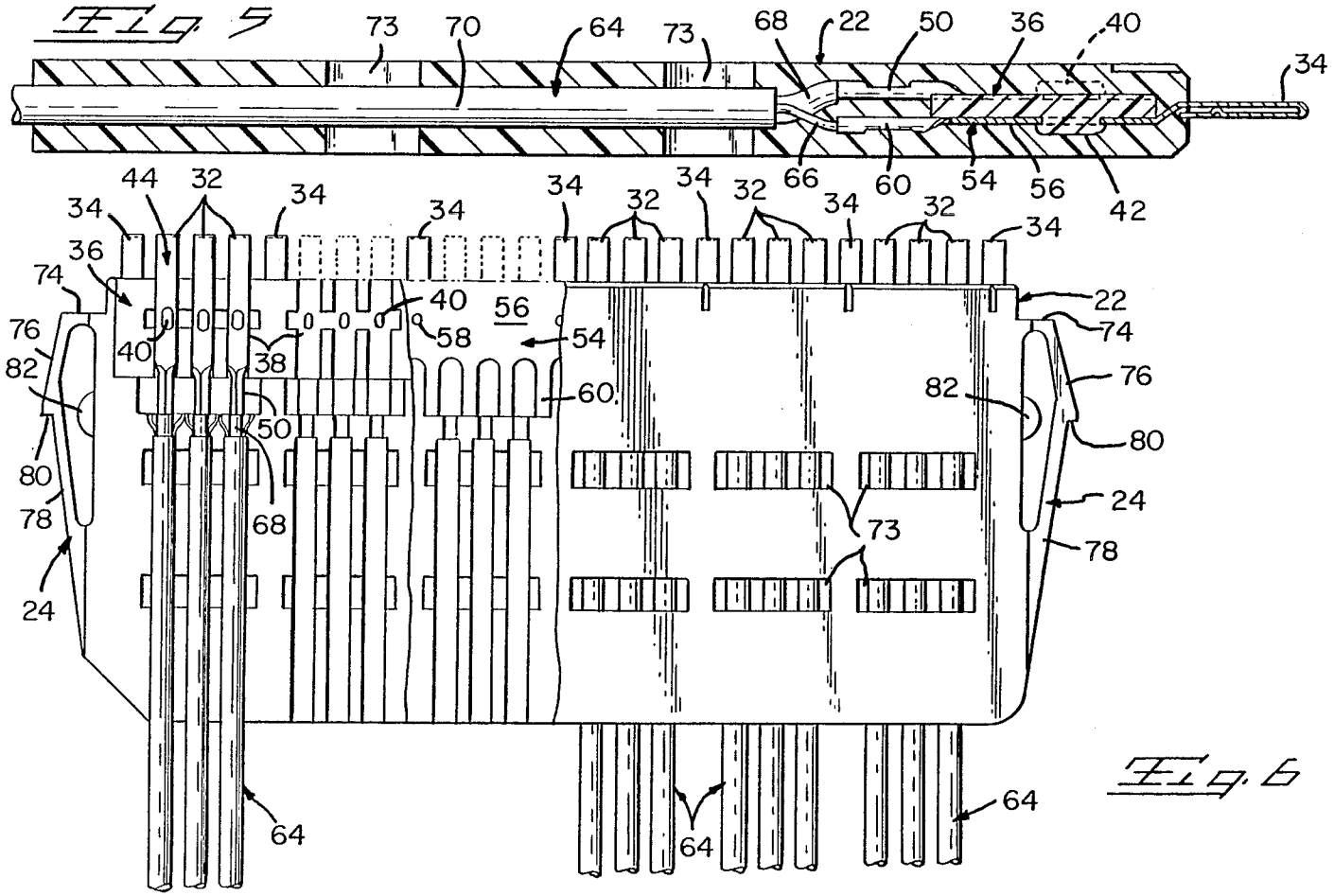
FIG. 5 is a longitudinal section view along line 5-5 of FIG. 4.
FIG. 6 is a top plan view with parts broken away of the plug connector.

FIGS. 2 through 9 illustrate electrical plug connector 22 in greater detail. Contact-carrying member 36 is molded from a suitable dielectric material and has spaced recesses 38 located in one surface thereof. First or oblong projections 40 are located in each of recesses 38 and serve as first securing means. Recesses 38 are disposed along member 36 in series of three recesses as illustrated in FIG. 6. Second or circular projections 42 extend outwardly from the bottom surface of member 36 at spaced intervals therealong and serve as second securing means.

Signal contact members 44 are stamped and formed from suitable metal stock and they include contact sections 32, central sections 46 having oblong holes 48 therein, and conductor-connecting or ferrule sections 50. Each of contact sections 32 has a double layer of metal which are maintained in spaced relationship with one another by inwardly-directed projection 52. Central section 46 is planar and is disposed in a respective recess 38 of contact-carrying member 36 with oblong projection 40 extending through oblong hole 48. When signal contact members 44 are secured in position in and against bottom surfaces of recesses 38 of contact-carrying member 36 via the outer ends of oblong projections 40 being enlarged by the application of pressure or heat, contact sections 32 are disposed proximate to and extend outwardly from the front end of member 36 along the longitudinal axis thereof while conductor-connecting sections 50 extend outwardly from the back end of member 36 along the same plane containing recesses 38.

A ground contact member 54 has an elongated planar section 56 along which are disposed holes 58 for engagement with circular projections 42 which planar section 56 is disposed against the bottom surface of contact-carrying member 36 whereafter the outer ends of projections 42 are enlarged by the application of pressure or heat thereby securing ground contact member 54 onto and against member 36. Adjacent the outer contact sections of the series of signal contact sections 32, ground contact sections 34 are disposed proximate to and extend outwardly from ground contact member 54 in the same manner as contact sections 32 and they have the same configuration as contact sections 32 so that ground contact sections 34 are disposed centrally of member 36 thereby being in longitudinal alignment in a common plane with contact sections 32. Conductor-connecting sections 60 extend outwardly from planar section 56 of ground contact member 54 and are located in the same plane as section 56 so that they extend outwardly from the back end of member 36.

As can be discerned, when signal contact members 44 and ground contact member 54 are secured in position on contact-carrying member 36, an electrical contact assembly is formed with contact sections 32 and 34 disposed centrally of the front end of contact-carrying member 36 and in alignment along member 36. Ground contact sections 34 are disposed adjacent the outer contact sections of the series of three signal contact sections 32 and this disposition of contact sections 32 and 34 takes place along the entire length of contact-carrying member 36. The arrangement of signal contact sections and ground contact sections can be in any manner as desired with ground contact sections 34 on each side of one or more signal contact sections 32 to make certain that optimum isolation of the signal information being processed along signal contact sections 32 takes place.

Figure 3:
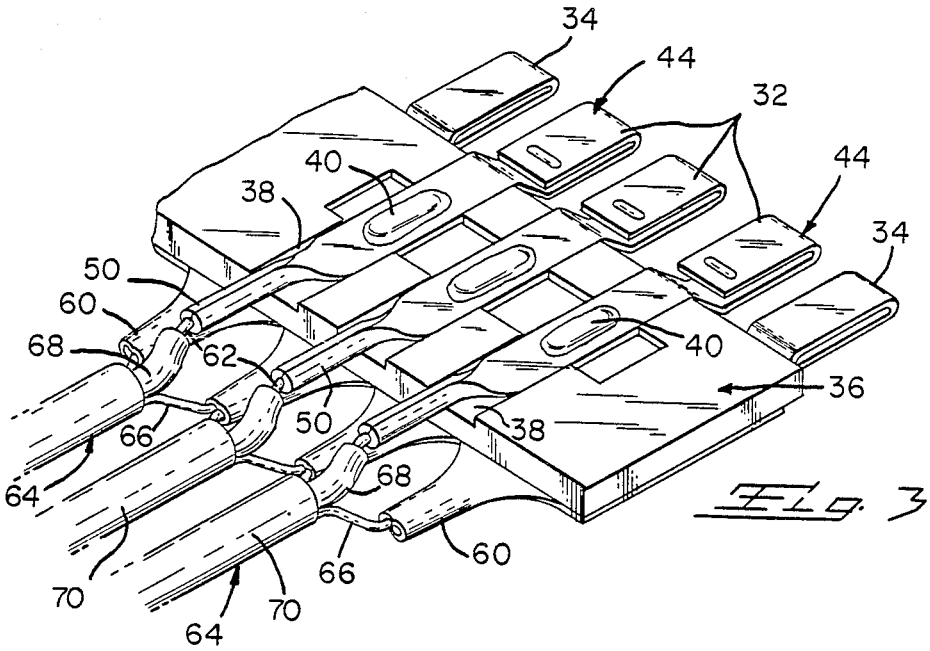
FIG. 3 is a perspective view of FIG. 2 in an assembled form.
Figure 4:
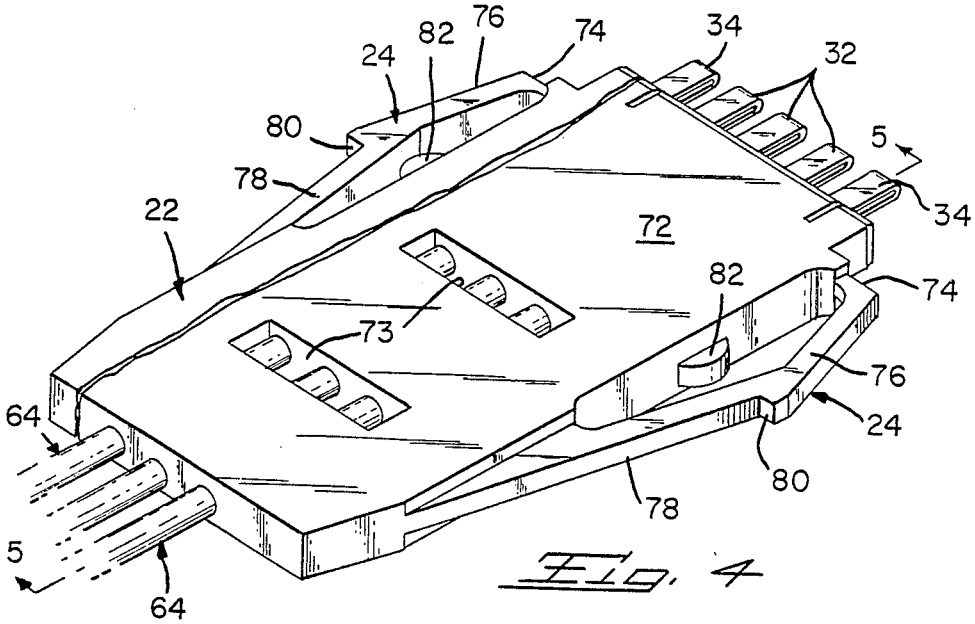
FIG. 4 is a perspective view of the plug connector in a completed form.

Conductor-connecting sections 50 and 60 are laterally spaced with respect to one another as shown in FIG. 3 and each conductor-connecting section 50 is centrally spaced with respect to conductor-connecting sections 60 on each side thereof as shown in FIGS. 3 and 6.

Contact-carrying member 36 spaces the signal contact members 44 relative to each other and signal contact members 44 relative to ground contact member 54.

Signal conductors 62 of three-lead coaxial cables 64 are disposed in the respective conductor-connecting sections 50 of signal contact members 44 while ground or drain conductors 66 of each of cables 64 are disposed in respective conductor-connecting sections 60 immediately below and to each side of conductor-connecting sections 50. Each cable 64 has a conductive coated plastic outer conductor surrounding the insulative sheath 68 covering signal conductors 62 which is electrically connected with a pair of drain conductors 66 thereby forming the three-lead coaxial cable 64 which also includes outer dielectric jacket 70. Signal conductors 62 and drain conductors 66 are secured in conductor-connecting sections 50 and 60 in accordance with conventional crimping practices thereby terminating signal conductors 62 in respective conductor-connecting sections 50 of signal contact members 44 and drain conductors 66 in respective conductor-connecting sections 60 of ground contact member 54. It is to be noted that conductor-connecting sections 60 are in a modified figure eight configuration to position drain conductors 66 from adjacent cables therein. If desired, signal conductors 62 and drain conductors 66 can be electrically connected to conductor-connecting sections 50 and 60 respectively by the use of a laser to laser-weld the conductors to the conductor-connecting sections.

After conductors 62 and 66 of cables 64 have been terminated to respective contact members 44 and 54, the terminated assembly is positioned in a mold which includes cable-positioning members so that dielectric housing 72 of suitable dielectric material is molded onto contact-carrying member 36 including the parts of the signal and ground contacts secured thereto and the terminations of cables 64 to conductor-connecting sections 50 and 60. Openings 73 are formed in housing 72 due to the cable-positioning members. Housing 72 also covers the inner parts of contact sections 32 and 34 as shown in FIG. 5, and also covers sections of cables 64 to space and support them and provide strain relief therefor. Housing 72 also environmentally seals the terminations, stabilizes the contact sections and supports them, and polarizes plug connectors 22 via flexible latch members 24 because one of them is thicker than the other.

The dielectric constant of the material of contact-carrying member 36 and housing 72 is substantially the same as that of the outer dielectric jacket of the cables to maintain the integrity of the signals being transmitted along the cables and the contact members.

Flexible latch members 24 are formed as integral latch members during the molding of the housing 72 and each latch member includes a stop surface 74 which engages against the inside surface of connector-receiving member 16. Each of flexible latch members 24 includes a front leg 65 and a rear leg 78 which are flexed inwardly when plug 22 is inserted within connector-receiving member 16 between spaced projections 20. When stop surfaces 74 of latch members 24 engage the inside front surface of connector-receiving member 16, latch members 24 flex outwardly with front legs 76 extending into openings 28 with latching surfaces 80 engaging surfaces 26 thereby latchably securing plug connector 22 in position in connector-receiving member 16 as shown in FIG. 9.

Arcuate projections 82 are located on housing 72 in alignment with legs 76 and 78 to prevent latch members 24 from being overstressed when plug connectors 22 are moved into connector-receiving member 16. As shown in FIG. 7, latch member 24 at the left side is thicker than latch member 24 on the right side and spaced projections 20 are accordingly spaced along connector-receiving member 16 thereby defining a polarizing arrangement to polarize the insertion of plug connectors 22 within connector-receiving member 16 to make certain that contact sections 32 and 34 are properly electrically connected with respective electrical receptacle contacts 14.

Whereas three-lead coaxial cables 64 have been disclosed as being terminated to the conductor-connecting sections of signal contact members 44 and ground contact member 54 of the connector assembly, a three-lead transmission cable can also be used wherein a signal conductor is isolated from drain conductors on each side thereof. The typical assembly utilizing the present invention is for ends of cables 64 or transmission cables to be terminated to electrical plug connectors 22 for transmitting electrical signals with high reliability and uniformity from a transmission source to a receiving member or vice versa.

Figure 10:
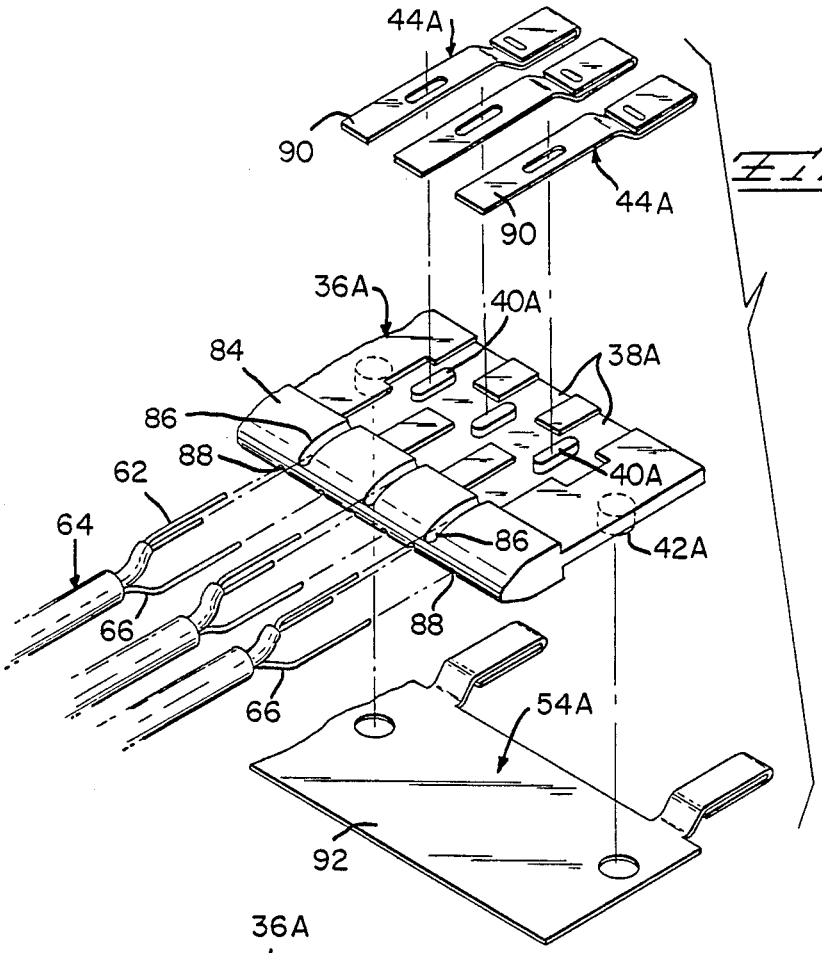
FIG. 10 is a view similar to FIG. 2 showing the parts of an alternative embodiment of the electrical contact assembly.
Figure 11:
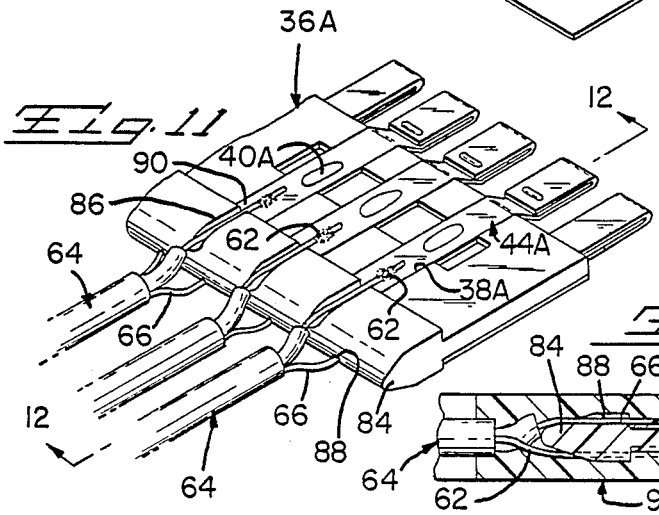
FIG. 11 is a view similar to FIG. 10 in an assembled form.
Figure 12:
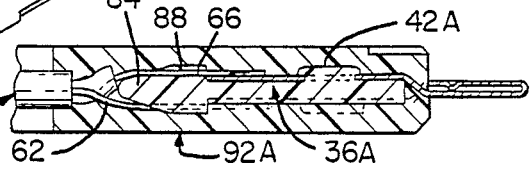
FIG. 12 is a longitudinal section view along line 12—12 of FIG. 11 with a housing secured on the contact assembly.
Figure 13:
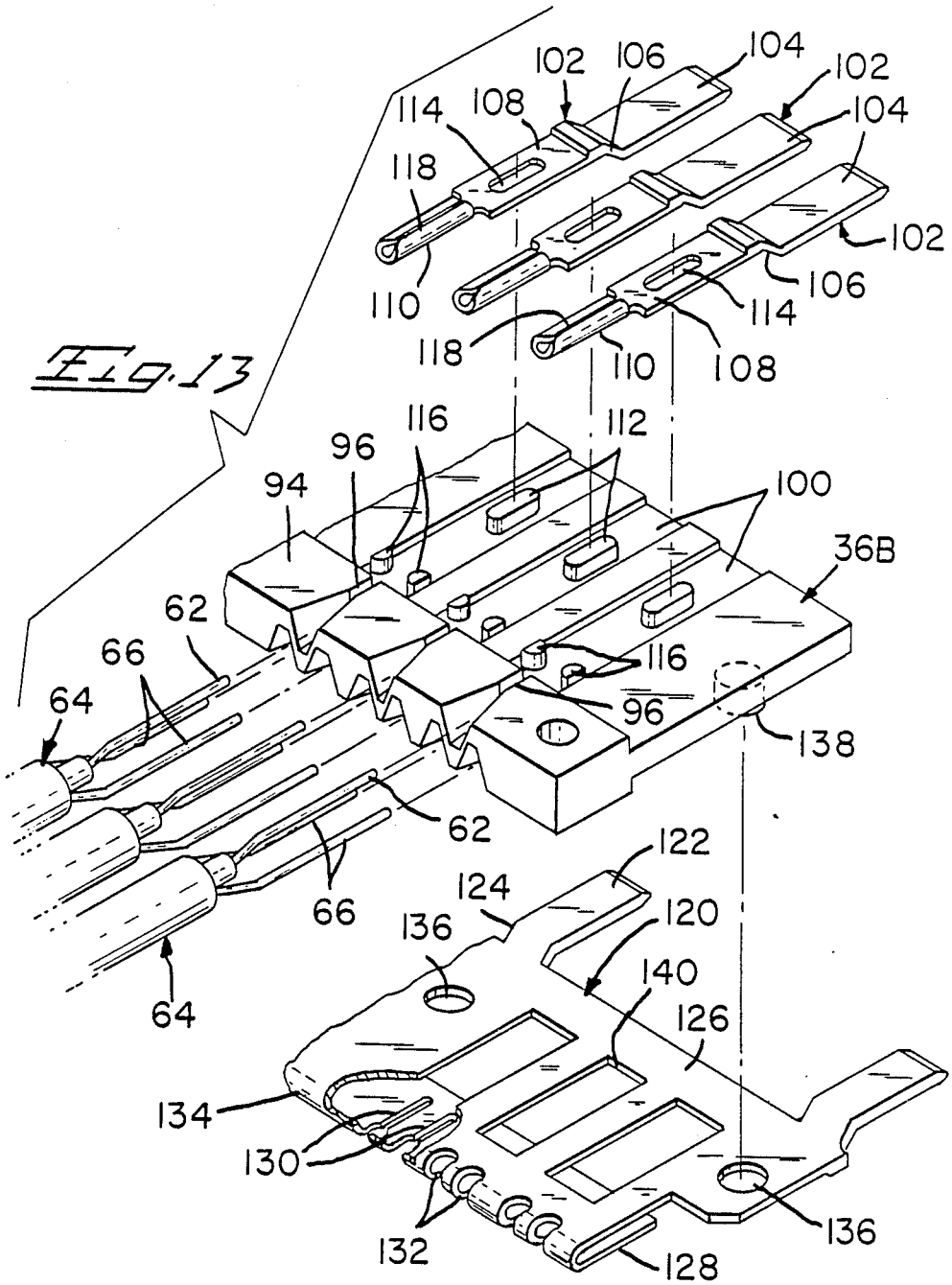
FIG. 13 is a view similar to FIGS. 2 and 10 showing the parts of a further embodiment of the electrical connector assembly.

FIGS. 10 through 12 illustrate an alternative embodiment of the electrical contact assembly wherein contact-carrying member 36A includes a conductor-positioning section 84 along which are conductor positioning means or channels 86 and 88. Channels 86 are centrally aligned with recesses 38A in which signal contact members 44A are secured via oblong projections 40A so that signal conductors 62 of cables 64 are positioned in channels 86 and in engagement with respective conductor-connecting sections 90 of signal contact members 44A which are engaged with conductor-positioning section 84. Ground conductors 66 of cables 64 are positioned along channels 88 on each side of a respective channel 86 and in engagement with a conductor-connecting section 94 of ground contact member 54A secured onto contact-carrying member 36A via projections 41A with section 92 engaged with section 84. Conductors 62 and 66 are welded respectively to conductor-connecting sections 90 of contact members 44A and conductor-connecting section 92 of contact member 54A, preferably by laser-welding techniques. Housing 92A is molded onto the terminated contact assembly.

FIGS. 13–16 illustrate a further embodiment of the electrical contact assembly wherein contact-carrying member 36B includes conductor-positioning section 94 along which conductor-positioning means or channels 96 are channels 96 are located in one side and channels 98 are located in the other side. Channels 96 are in communication with recesses 100 and both of channels 96 and 98 include beveled surfaces to guide signal conductors 62 and ground conductors 66 of cables 64 respectively along channels 96 and 98.

Signal contact members 102 are stamped and formed from pre-rolled or pre-milled metal stock with contact sections 104 being thicker than bent sections 106 which are thicker than central or mid sections 108 and ferrule sections 110. Mid sections 108, part of bent sections 106, and ferrule sections 110 of signal contact members 102 are disposed in respective recesses 100 serving as first securing means with oblong projections 112 in recesses 100 extending through oblong holes 114 of mid sections 108 and ferrule sections being disposed between aligning projections 116 at the inner ends of recesses 100. Aligning projections 116 align ferrule sections 110 in recesses 100 so that slots 118 in ferrule sections 110 are in alignment with respective channels 96, slots 118 having a width slightly less than the diameter of signal conductors 62 so that they can be force-fitted thereinto. After signal contact members 102 are positioned in recesses 100, projections 112 are mechanically or thermally deformed thereby securing contact members 102 in position with contact sections 104 proximate the front end of contact-carrying member 36B and extending outwardly therefrom and being centrally aligned in a common plane along the front surface of contact-carrying member 36B.

Ground contact member 120 is stamped and formed from pre-rolled or pre-milled metal stock with contact sections 122 being thicker than bent sections 124 which are thicker than central section 126 which has a folded-over section 128 in which slots 130 are located. Slots 130 are in communication with respective openings 132 in bight section 134 which neck down as they merge with slots 130. The width of slots 130 are slightly smaller than the diameter of conductors 66 so that they can be force-fitted thereinto.

Planar section 126 has holes 136 through which circular projections 138 on contact-carrying member 36B extend when ground contact member 120 is mounted thereon. Projections 138 serve as second securing means and are mechanically or thermally deformed thereby securing contact member 120 on member 36B with contact sections 122 extending outwardly from and being centrally aligned along the front surface of member 36B so that contact sections 104 and 122 are in alignment. Planar section 126 also has openings 140 therein opposed from planar central sections 108 of signal contact members 102 which are designed in size and location to tailor the impedance of the assembly to approximate the characteristic impedance of the cable.

Figure 14:
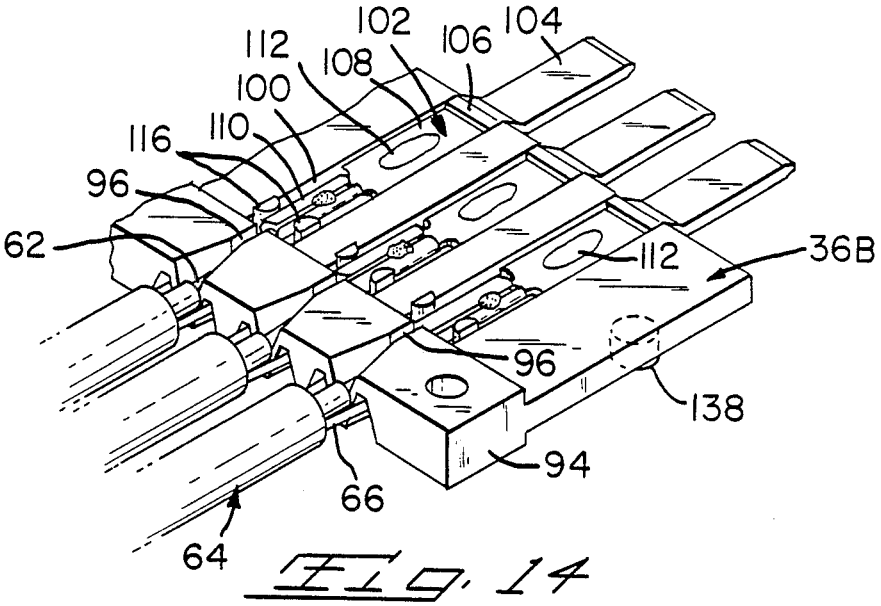
FIGS. 14 and 15 are perspective views of FIG. 13 in an assembled form.
Figure 15:
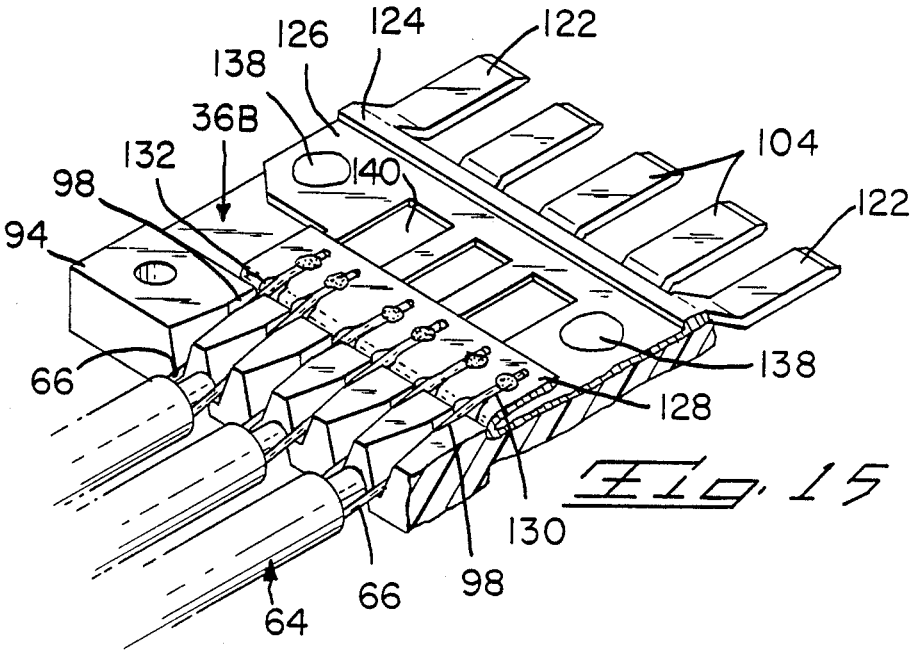

After contact members 102 and 120 have been secured to member 36B, conductors 62 and 66 of cables 64 are guided by channels 96 and 98 so as to be positioned along slots 118 and 130 of respective contact members 102 and 120. These conductors are then force-fitted into slots 118 and 130 whereafter they are laser welded in position in accordance with conventional welding practices thereby forming the electrical contact assembly as shown in FIGS. 14 and 15.

Figure 16:
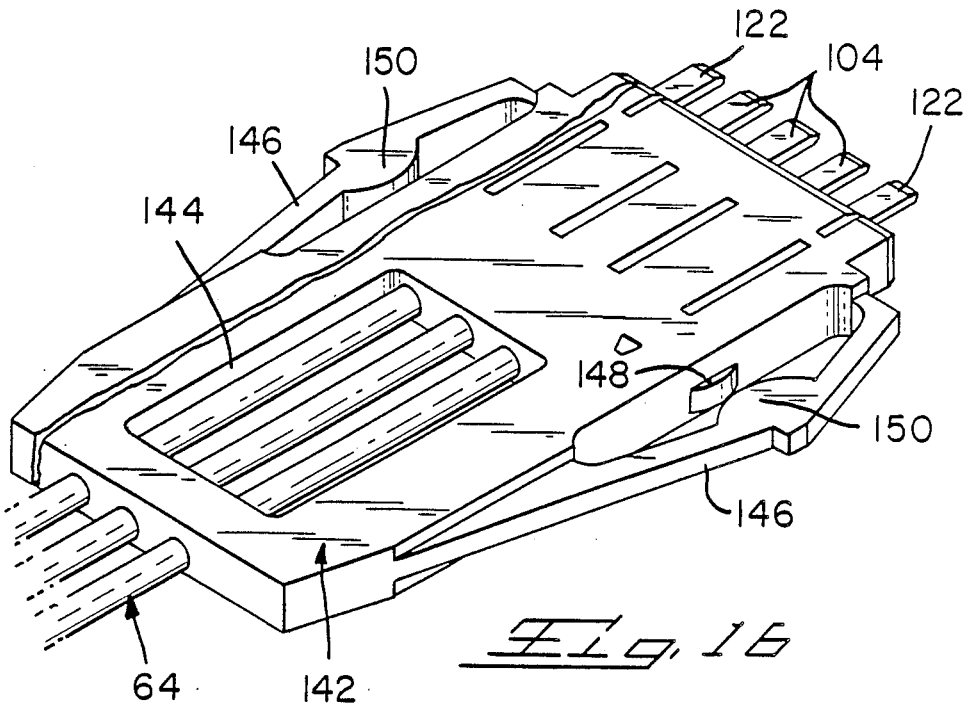
FIG. 16 is a perspective view of the plug connector of FIGS. 13–15 in a completed form.

Dielectric housing 142 as shown in FIG. 16 is molded onto the contact assembly in the same manner as that of housing 72 and housing 142 has a single opening 144 to minimize engagement with cables 64 to prevent distortion thereto. Integral flexible latch members 146 of different widths extend outwardly from the sides of housing 142 and arcuate projections 148, 150 are located on housing 142 and latch members 146 to prevent overstressing of latch members 146. Housing 142 otherwise functions the same as housing 72 and the dielectric constant of the material of member 36B and housing 142 is substantially the same as that of cables 64 to maintain the integrity of the signals being transmitted along the cables and the plug member.

What is claimed is:

1. A contact subassembly for an electrical connector for a plurality of signal conductor means and ground conductor means of electrical cable means for use in transmitting electrical signals with high reliability and uniformity, comprising:

a dielectric contact-carrying member having a first side and an opposite second side, a forward end, and a rearward end, at least said first side including means defined by surface portions extending outwardly therefrom spaced at intervals thereacross for locating contact members at desired contact locations and aligning said contact members upon assembly thereto to extend in a desired alignment from at least proximate said rearward end to said forward end;

a plurality of signal contact members disposed on said first side of said contact-carrying member at spaced intervals therealong spaced and aligned by said locating and aligning means of said first side;

ground contact means disposed on said second side thereof; and first and second securing means respectively securing each said signal contact member and said ground contact means against the respective sides of said contact-carrying member, signal contact sections of said signal contact members and ground contact section means of said ground contact means disposed proximate a front end of said contact-carrying member, and conductor-connecting sections of said signal contact members and conductor-connecting section means of said ground contact means extending along said contact-carrying member proximate a rear end thereof to be terminated to respective ones of said signal and ground conductor means.

2. A contact subassembly as set forth in claim 1 wherein said first side of said contact-carrying member has spaced recesses in which planar central sections of said signal contact members are disposed, said first securing means comprise first projections in said recesses extending through holes in said planar central sections, and said second securing means comprise second projections extending outwardly from said second side of said contact-carrying member and extending through holes in planar central section means of said ground contact means, outer ends of said first and second projections being disrupted thereby securing said signal contact members and said ground contact means against the respective sides of said contact-carrying member.

3. A contact subassembly as set forth in claim 1 wherein said first securing means comprise non-circular first projections extending outwardly from said first side at said spaced locations and through corresponding non-circular holes in planar central sections of said signal contact members, said first projections being located to position respective said signal contact members at desired locations and said first projections and said holes being shaped to align said signal contact members to extend in a desired alignment from at least proximate said rearward end to said forward end upon assembly of said signal contact members to said contact-carrying member without alignment tooling, outer ends of said first projections being disrupted thereby securing said signal contact members against said first side of said contact-carrying member.

4. A method of making an electrical connector for conductor means of electrical cable means, comprising the steps of:

forming a thin dielectric contact-carrying member having a first side, and opposite second side, a forward end, and a rearward end, at least said first side including means defined by surface portions extending outwardly therefrom spaced at intervals thereacross for locating contact members at desired contact locations and aligning said contact members when assembled thereto to extend in a desired alignment from at least proximate said rearward end to said forward end, whereby said contact-carrying member is adapted to receive contact members at defined locations across at least said first side and aligned to extend in said desired alignment from proximate said rearward end to said forward end without spacing and aligning by tooling;

disposing and securing a plurality of contact members at said spaced intervals defined by said locating and aligning means along at least said first side of said contact-carrying member such that contact sections of said contact members are disposed proximate said forward end and exposed to be engaged by corresponding contact means of a mating electrical article, and conductor-connecting sections are disposed proximate said rearward end and exposed to permit termination of respective conductor means of electrical cable means thereto, thereby defining a contact subassembly having spaced and aligned contact members along at least said first side;

terminating said respective conductor means to said conductor-connecting sections of said contact members; and providing a forward housing means around said contact subassembly having said conductor means terminated to respective said contact members, defining a connector.

* * * * *